US005189456A

United States Patent [19]

Sherburne et al.

[11] Patent Number: 5,189,456

[45] Date of Patent: Feb. 23, 1993

[54] METHOD AND APPARATUS FOR ADJUSTING THE VOLUME OF REPLENISHMENT FLUID PROVIDED TO A CHAMBER OF A FILM PROCESSOR

[75] Inventors: David G. Sherburne, Ontario; April M. Seim, Spencerport; Michael G. Howe, Bloomfield, all of N.Y.

[73] Assignee: Eastman Kodak Company, Rochester, N.Y.

[21] Appl. No.: 767,757

[22] Filed: Sep. 30, 1991

[51] Int. Cl.[5] ..... G03D 13/00

[52] U.S. Cl. ..... 354/298; 354/324

[58] Field of Search ..... 354/298, 324; 137/392, 137/486, 487.5, 624.11, 624.13

[56] References Cited

U.S. PATENT DOCUMENTS

| | | | |
|---|---|---|---|
| 4,021,832 | 5/1977 | Krehbiel et al. | 354/298 |
| 4,104,670 | 8/1978 | Charnley et al. | 354/324 |
| 4,222,657 | 9/1980 | Leuchter | 354/324 |
| 4,293,211 | 10/1981 | Kaufmann | 354/298 |
| 4,556,305 | 12/1985 | Osegowitsch | 354/298 |
| 4,999,660 | 3/1991 | Wright | 354/324 |

*Primary Examiner*—Richard A. Wintercorn
*Assistant Examiner*—D. Rutledge
*Attorney, Agent, or Firm*—Frank Pincelli

[57] ABSTRACT

A processor has switches that detect events during operation of the processor and provide signals to a microprocessor which controls operation of the processor. A replenishment system for a processing fluid includes a pump that provides replenishment fluid to a chamber. The processor control is changed to a calibration mode of operation and the switches are used to determine the volume of fluid provided by the pump during one cycle of operation of the replenishment system, and then, if necessary, to adjust the time the pump is operated to increase or decrease the volume of fluid delivered during one cycle of operation.

4 Claims, 2 Drawing Sheets

FIG. 1
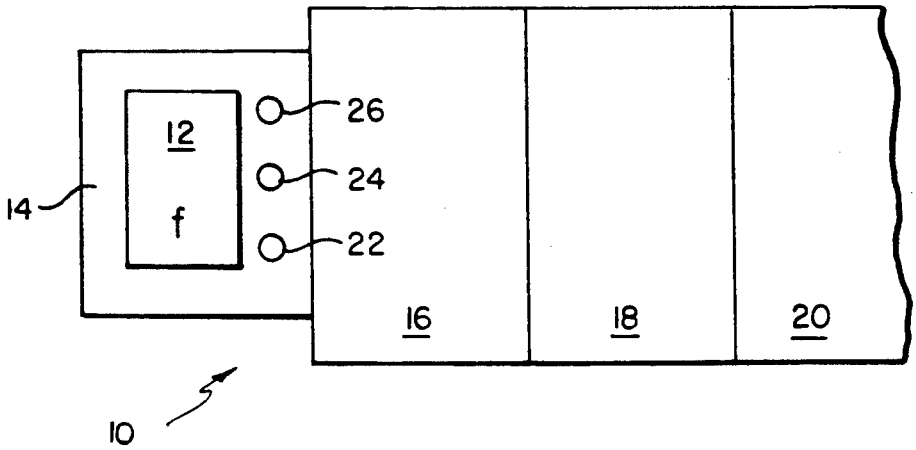
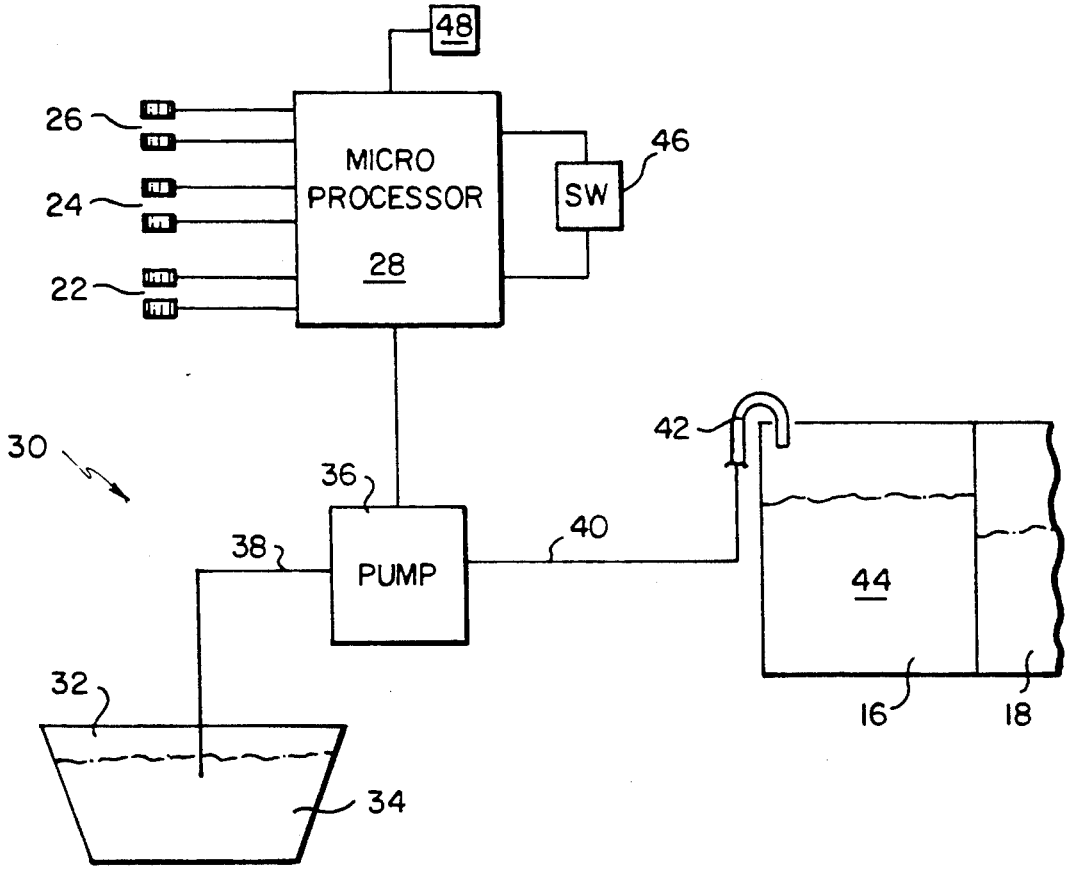
FIG. 2

METHOD AND APPARATUS FOR ADJUSTING THE VOLUME OF REPLENISHMENT FLUID PROVIDED TO A CHAMBER OF A FILM PROCESSOR

BACKGROUND OF THE INVENTION

The present invention relates to method and apparatus for adjusting the volume of a replenishment fluid provided to a chamber in a film processor during one cycle of operation of the replenishment system and, more particularly, to such a method and apparatus wherein switches used to sense events during a normal run mode of operation are utilized for other purposes during measurement and adjustment of the volume of replenishment fluid provided during a cycle of operation.

Processors are known which have a pump used during a replenishment cycle of operation to provide a volume of replenishment fluid to a chamber in a film processor. The volume of fluid provided during one cycle of the replenishment system may be adjusted using mechanical cams for the pump of the replenishment system. Such adjustment requires a large amount of trial and error, and thus time, in order to adjust the system so that the volume of fluid delivered in one cycle equals the standard or desired amount. The processor operator may not be able to adjust the cams, so a skilled service person may need to travel to the processor when cam adjustment is required. Another problem with such systems is that an operator or service person needs access to the pumps and cams. The pumps and cams may be located where they are not readily accessible. Also, the need for a person to make adjustments in the presence of mechanical apparatus increases the risk of injury to a person during such adjustments. Therefore, guards or other devices may be required to protect a person while adjustments are made, and such devices increase the cost of the apparatus. Also, the cams used are relatively expensive, thereby increasing the overall cost of the pump and the replenishment system. However, the output accuracy of the pump changes as the stroke of the pump changes. Another problem in designing processors, especially low cost processors, is to minimize the number of parts needed to accomplish the various functions and features of the processor. Thus, it is desirable to use parts for more than one function, if possible. This minimizes cost of parts and reduces the assembly cost.

SUMMARY OF THE INVENTION

Accordingly, an object of the invention is to effect adjustment of the volume of fluid provided by a replenishment system during a cycle of operation without adjustment of cams and in a way which reduces the likelihood that an operator might be injured in the process of making the necessary adjustments to the replenishment system. Another object is to reduce the cost of a processor by utilizing some parts for one function during a normal run mode of operation and for a second function during a replenishment calibration mode of operation.

In one aspect, the present invention relates to an improvement in a processor for developing latent images on a photosensitive material. The processor has a chamber for holding a processing fluid that periodically needs to be replenished, and a plurality of switches for detecting events occurring during operation of the processor. A processor control receives signals in response to the switches detecting events, and a replenishment system is operable when cycled once to deliver a quantity of replenishment fluid to the chamber. The improvement includes means for changing the processor control from a normal mode of operation to a replenishment adjustment mode of operation, the changing means being effective to change the function of the switches so that 1) a first one of the switches is effective to initiate one cycle of operation of the replenishment system, 2) a second one of the switches is effective to increase the volume of fluid delivered during one cycle of the replenishment system, and 3) a third one of the switches is effective to decrease the volume of fluid delivered during one cycle of the replenishment system.

In another aspect, the present invention relates to an improvement in a method for processing a photosensitive material using a processing fluid that periodically needs replenishment, the processing method including the steps of detecting events during processing of the material by using a plurality of switches, and periodically cycling a replenishment system once to add a quantity of replenishment fluid to the processing fluid. The improvement includes the steps of switching the processing control from a normal operational mode to a replenishment adjustment mode of operation, closing a first one of the switches to initiate a replenishment cycle of operation, and measuring the volume of the replenishment fluid delivered during the replenishment cycle. The measured volume is compared to a standard volume to determine if the measured volume is more or less than the standard volume, and the volume of fluid delivered during a replenishment cycle is adjusted, if necessary, by closing a second one of the switches to decrease the volume of fluid delivered or by closing a third one of the switches to increase the volume of fluid delivered.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a fragmentary plan view illustrating a portion of a film processor and showing a sheet of film positioned to be fed into the processor;

FIG. 2 is a schematic view illustrating a replenishment system for the processor of FIG. 1 and portions of the control system for the processor and replenishment system.

DETAILED DESCRIPTION OF THE PREFERRED EMBODIMENT

Figure 3:
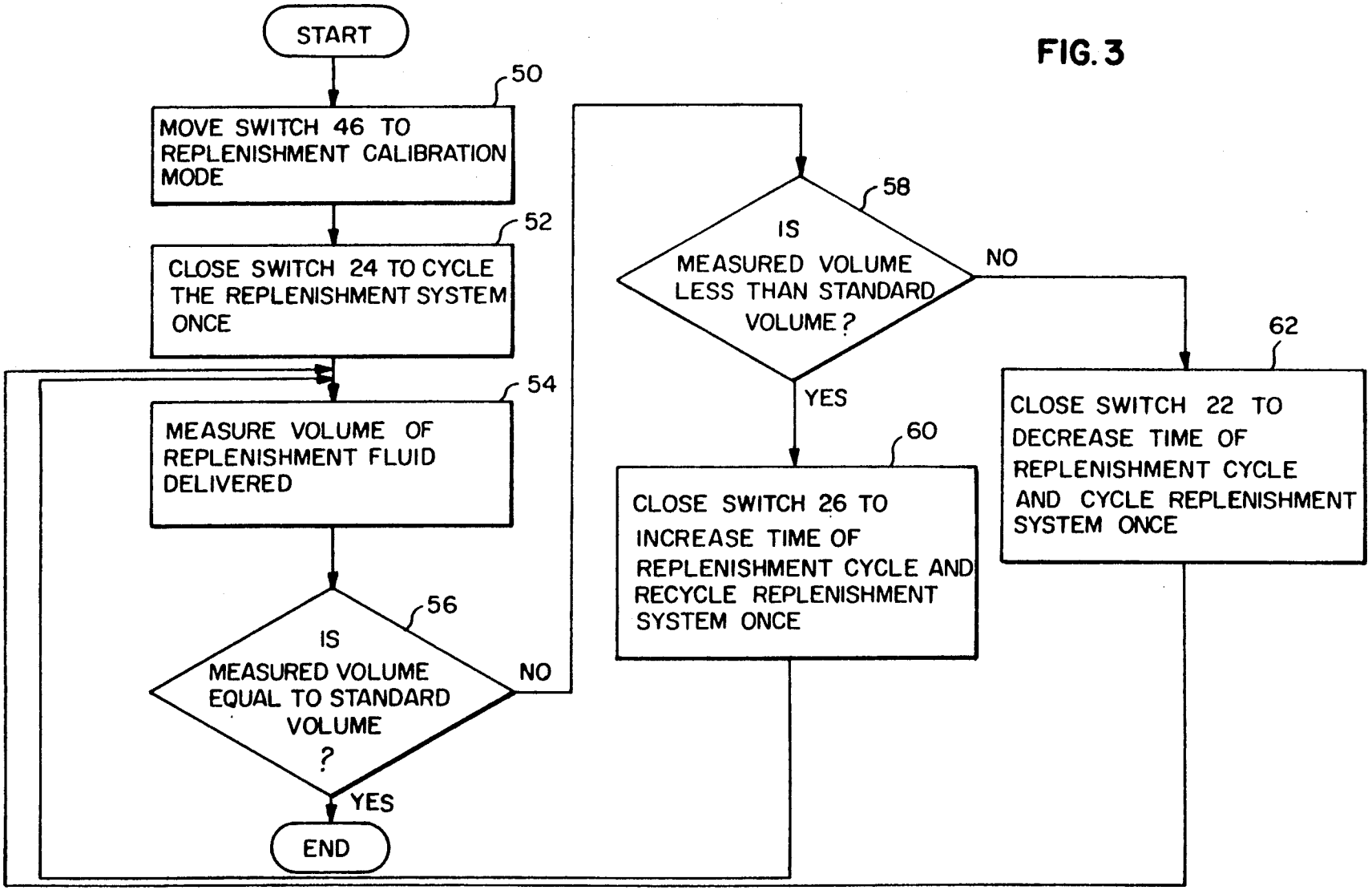
FIG. 3 is a flow diagram illustrating the operation of the apparatus of the invention and showing steps in the method of the invention.

Referring now to FIG. 1, a processor incorporating the invention is generally designated 10 and is used for developing latent images on photosensitive material. The photosensitive material may be of various kinds and, as illustrated in the drawings, comprises a sheet of x-ray film 12. The film is placed on a tray 14 at the entrance to the processor and then moved to the right as viewed in FIG. 1 for circulation through a plurality of chambers or processing stations comprising, for example, a developer station 16, a fixer station 18 and a wash station 20 at which processing fluids are washed from the sheet of film. Stations 16, 18 and 20 comprise chambers through which the sheet is fed during film processing. Station 16 holds a quantity of developer solution and the station 18 holds a quantity of fixer solution, both of which are depleted during operation of the processor and need to be periodically replenished. The following description refers to replenishment of the developer solution, but the same apparatus and method apply to replenishment of both developer and fixer solutions.

At the entrance to the developer station 16, there are provided a plurality of sensors 22, 24 and 26 that detect an event occurring during operation of the processor. Preferably, the sensors comprise switches that detect a film sheet 12 as it is advanced along the surface of a tray 14 toward the developer station. The sensors can be used to initiate development operation of the processor, or to sense the number and/or size of film sheets delivered to the film processor. The switches 22–26 are coupled directly or indirectly to a processor control system which preferably comprises a programmable microprocessor generally designated 28. The microprocessor thus receives signals from the switches 22–26 in response to the switches sensing the presence of the film sheet 12. For example, the microprocessor can use such information relating to the number and size of film sheets processed for determining when a quantity of replenishment solution should be delivered to the developer station 16 or the fixer station 18.

Switches 22–26 can be infrared optical switches of the kind commonly used for sensing film in a processor. Other kinds of switches also can be used, such as mechanical switches.

Processor 10 has a replenishment system generally designated 30 which is controlled by the microprocessor and is operable to periodically deliver a measured quantity of replenishment solution to the chambers 16, 18 or 20. In the drawings, the replenishment system is shown connected to the developer chamber 16. As mentioned before, it will be understood that a similar system is used for providing replenishment fluid to the fixer chamber 18.

Replenishment system 30 comprises a tank or container 32 that receives and holds a concentrated replenishment solution 34. A pump 36 is connected by a conduit 38 to the replenishment solution in the container 32, and another conduit 40 connects the outlet of the pump 36 to a "J" shaped tube 42 located at the top of the developer station 16 so that when the pump is operated, replenishment fluid 34 is pumped through conduits 38,40 and tube 42 into the developer chamber 16. The end of the tube 42 in the developer chamber 16 is located above the level of the developer fluid 44 by a distance sufficient to enable the operator to catch and measure the replenishment solution furnished during a cycle of operation of the replenishment system, as explained in more detail later. The microprocessor 28 is coupled to the pump 36, as illustrated in FIG. 2 so that the microprocessor is effective to control the replenishment cycle. More specifically, the volume of replenishment solution provided during a cycle of operation of the replenishment system can be varied by the microprocessor adjusting the time that the pump 36 operates during the replenishment cycle.

Over a period of time, the quantity of replenishment solution furnished during a cycle of the replenishment system may change. Accordingly, provision needs to be made to calibrate the replenishment system periodically. When the replenishment system is to be calibrated, the volume of replenishment fluid furnished to a chamber, such as developer chamber 16, during one cycle of the replenishment system is measured to determine if the standard or desired volume of replenishment fluid is being provided during the cycle, and to make changes as may be necessary to increase or decrease the quantity of replenishment solution furnished during a cycle.

In accordance with the present invention, the microprocessor 28 can be changed from a normal or "run" mode of operation to a replenishment calibration or adjustment mode of operation by means of a switch 46. Switch 46 may be mounted on the processor so that it is changed from its "run" setting to its calibration setting when a cover or door on the processor is moved from a closed to an open position. When switch 46 is set to the replenishment calibration mode of operation, the function of switches 22, 24 and 26 is changed by the microprocessor so that they are used for the measuring and adjustment of the replenishment system. More specifically, the processor operator or a service person can manually close switch 24 in order to initiate one cycle of operation of the replenishment system 30. If switches 22–26 are infrared optical switches having an emitter or detector, then switch 24 is closed by the service person placing an object, such as a sheet of paper, between the emitter and detector of the switch 24. The service person will hold a container beneath the open end of the tube 42 in order to catch the replenishment fluid delivered during the entire cycle of the replenishment system 30. The operator then measures the volume of replenishment fluid delivered during a cycle. This can conveniently be done by catching the solution in a graduated beaker or container. By way of example, in a typical cycle of operation, approximately 60 ml of developer replenishment solution might be the standard amount desired to be furnished during a cycle of operation. If the service person determines that the measured volume is equal to the desired or standard volume, then switch 46 is returned to the normal mode of operation which allows switches 22–26 to sense the presence of a film sheet on the tray 14.

If the operator determines that the quantity of replenishment fluid exceeds the desired or standard volume, then the operator closes switch 22 one or more times to signal the microprocessor to decrease the time that the pump 36 is operated during a replenishment cycle. For example, if the desired or standard volume furnished during the test cycle exceeded the standard volume by 5 ml, then the switch 22 may only be closed once, and an appropriate adjustment will be made for decreasing the time of operation of the pump 36 by the software in the microprocessor. On the other hand, if the measured amount was 10 ml greater than the standard amount, the switch 22 would be closed twice to signal the microprocessor that a greater adjustment needs to be made in the time cycle of the pump 36. Similarly, if the measured volume is less than the standard volume, then the switch 26 is closed one or more times to signal the microprocessor to increase the time pump 36 is operated, and thereby increase the volume of replenishment fluid delivered during a cycle of the replenishment system.

FIG. 3 is a flow chart illustrating the process of the invention and the operation of the apparatus disclosed in FIGS. 1 and 2. More specifically, at the start of the operation, switch 46 is set to switch the processor and the microprocessor to a calibration mode, as shown at 50, thus enabling the measurement and adjustment of the replenishment system. Then switch 24 is closed to cycle the replenishment system once, as shown at 52. The volume delivered by the replenishment system is measured as shown at 54, and a determination is made as to whether the measured volume equals the standard volume, as shown at 56. If it does, then the calibration mode is terminated by setting the switch 46 to the run mode of operation. If not, then a determination is made as to whether the measured volume is less than the standard volume as indicated at 58. If it is, then switch 26 is closed one or more times to increase the time of the replenishment cycle and re-cycle the replenishment system once, as indicated at 60. The volume delivered is again measured as shown at 54, and a determination is made if it is equal to the standard volume. If it is, then the cycle is terminated, and if not, another determination is made as to whether the amount delivered is less than the standard volume. This cycle may need to be repeated more than once in order to obtain the desired volume per cycle.

On the other hand, if measurement of the volume delivered indicates that it is neither equal to nor less than the standard volume, then switch 22 is covered to decrease the time of the replenishment cycle, and the replenishment system is cycled once, as indicated at 62, so that the new volume of replenishment fluid delivered during a cycle can be measured. The process is then repeated again as many times as necessary until the measured volume is equal to the standard volume. At that time, the service person sets the switch 46 to return the microprocessor to the normal "run" mode of operation and discontinue the calibration mode of operation.

It may be desirable to sound an audible signal each time one of the switches 22, 24 and 26 is closed so that the service person will know that one signal has been sent to the microprocessor. Thus, an annunciator 48 (FIG. 2) can be provided and coupled to the logic and control system to sound an alarm each time one of the switches is closed. This is particularly desirable when switches 22 or 26 are closed several times in order to make more than the minimum adjustment in the time of operation of the pump 36. Alternatively, lamps (not shown) on the processor control panel can be flashed on and off to provide a visible signal, instead of an audible signal.

Pump 36 can be a cam operated bellows pump. Some of the disadvantages of a cam operated pump have been mentioned previously. Because the amount of fluid furnished during one cycle of operation of the replenishment system 30 is a function of the time the pump 36 is operated, the pump does not need to be a cam operated pump. In a preferred embodiment of the invention, the pump is a peristaltic pump, which is less expensive than commonly used bellows pumps, and does not use cams for controlling the volume of fluid delivered by the pump. The less-expensive peristaltic pump is especially desirable for use in low-cost processors incorporating the present invention where costs can be reduced by such a pump but the quality and precision of operation are not compromised by use of such a pump.

As mentioned previously, it is desirable to provide a replenishment system for both the developer solution 44 and the solution provided to the fix chamber 18. The system described is illustrated in FIG. 2 as being provided to chamber 16, but an identical system can be used for providing replenishment fluid to chamber 18. If desired, a single motor can be provided for operating two pumps, one used for delivering replenishment solution to the developer chamber and another for providing replenishment solution to the fix chamber. Since the standard or desired volume provided to the two chambers is different, by using paristaltic pumps, the conduit 40 from one of the pumps can be one diameter and the conduit 40 from the other pump and be a smaller diameter to thereby provide different quantities of replenishment solution to the two chambers each time the pump motor is operated. In addition, two separate pumps with their own motors could be provided in which case the three switches 22-26 could be replaced with six switches and each system calibrated independently in the manner described for the system 30. Alternatively, if two pumps with separate motors are used, the microprocessor can be programmed so that calibration of one replenishment system is carried out using the three switches 22-26, as described before for the developer replenishment system. Then all three switches are simultaneously closed to signal the microprocessor to begin calibration of the second replenishment system, which is carried out using the same three switches 22-26, as previously described.

The system of the present invention has a number of advantages. More specifically, the need to adjust cams for calibrating the replenishment system, as explained previously, is eliminated and in its place a simple adjustment of the time of operation of the pump is provided through the programmed microprocessor 28. This is much easier for the operator and, in addition, the operator can perform the task of calibrating the replenishment system from the top near the front of the processor and without need to be near the pumps, thereby reducing the possibility of injury to the operator. This eliminates the need for guards or other devices which protect the person making adjustments on the cams. Also, the accuracy of pumps using cams can change over time due to wear of the pump cams, and the replenishment system calibration mode of the present invention easily compensates for such wear by simply increasing or decreasing the time of operation of the pump. The replenishment system can be adjusted by the operator of the processor, without the need to call trained service people.

Some of the disadvantages of cam operated pumps, as discussed before, are eliminated, and the invention enables a lower-cost peristaltic pump to be used. The use of such a pump reduces the cost of the replenishment system, making it desirable for use on low-cost processors.

The invention has been described in detail with particular reference to a preferred embodiment thereof, but it will be understood that variations and modifications can be effected within the spirit and scope of the invention.

We claim:

1. In a processor for developing latent images on a photosensitive material, the processor having at least one chamber for holding a processing fluid that periodically needs to be replenished, a plurality of switches for detecting events occurring during operation of the processor to develop latent images, a processor control coupled to the switches for receiving signals in response to the switches detecting events, a replenishment system operable when cycled once to deliver a quantity of replenishment fluid to the chamber, the processor control being connected to the replenishment system, the improvement comprising:

means for changing the processor control from a normal mode of operation to a replenishment adjustment mode of operation wherein the volume of replenishment fluid furnished to the chamber during one cycle of the replenishment system can be measured and adjusted, the changing means being effective to change the function of three of the switches so that 1) a first one of the switches is effective to initiate one cycle of operation of the replenishment system so that the volume of replenishment fluid delivered during a cycle can be measured and compared to a standard volume, 2) a second one of the switches is effective to increase the volume of fluid delivered during one cycle of the replenishment system, and 3) a third one of the switches is effective to decrease the volume of fluid delivered during one cycle of the replenishment system.

2. The invention as set forth in claim 1, wherein the processor has a surface along which the photosensitive material is advanced toward the chamber, and the switches are located with respect to the surface for detecting the material being advanced along the surface when the processor control is in its normal mode of operation.

3. The invention as set forth in claim 1, wherein the pump is a peristaltic pump.

4. In a method for processing a photosensitive material using a processing fluid that periodically needs replenishment, the processing method including the steps of detecting events during processing of the material by using a plurality of switches, providing signals to a processor control in response to detection of an event, periodically cycling a replenishment system once to add a quantity of replenishment fluid to the processing fluid, the improvement comprising the steps of:

switching the processing control from a normal operational mode to a replenishment adjustment mode of operation wherein the volume of replenishment fluid furnished to the processing fluid during one cycle of the replenishment system can be measured and adjusted, closing a first one of the switches to initiate a replenishment cycle of operation wherein replenishment fluid is delivered from a source of such fluid, measuring the volume of the replenishment fluid delivered during the replenishment cycle, comparing the volume to a standard volume to determine if the volume is more or less than the standard volume, adjusting the volume of fluid delivered during a replenishment cycle by closing a second one of the switches to decrease the volume of fluid delivered or by closing a third one of the switches to increase the volume of fluid delivered.

* * * * *